US011208292B2

(12) United States Patent
Mazzaccherini et al.

(10) Patent No.: US 11,208,292 B2
(45) Date of Patent: Dec. 28, 2021

(54) FOLDING ROLLER AND MACHINE COMPRISING SAID ROLLER

(71) Applicant: FABIO PERINI S.P.A., Lucca (IT)

(72) Inventors: Graziano Mazzaccherini, Porcari (IT); Franco Montagnani, Palaia (IT); Alessandro Morelli, Lucca (IT)

(73) Assignee: Fabio Perini S.p.A., Lucca (IT)

( * ) Notice: Subject to any disclaimer, the term of this patent is extended or adjusted under 35 U.S.C. 154(b) by 0 days.

(21) Appl. No.: 17/049,376

(22) PCT Filed: Apr. 18, 2019

(86) PCT No.: PCT/IB2019/053225
§ 371 (c)(1),
(2) Date: Oct. 21, 2020

(87) PCT Pub. No.: WO2019/207434
PCT Pub. Date: Oct. 31, 2019

(65) Prior Publication Data

US 2021/0238003 A1 Aug. 5, 2021

(30) Foreign Application Priority Data

Apr. 27, 2018 (IT) ..... 102018000004955

(51) Int. Cl.
*B65H 45/24* (2006.01)
*B65H 45/20* (2006.01)
*B65H 45/28* (2006.01)

(52) U.S. Cl.
CPC ..... *B65H 45/24* (2013.01); *B65H 45/20* (2013.01); *B65H 45/28* (2013.01); *B65H 2555/14* (2013.01); *B65H 2701/11231* (2013.01); *B65H 2701/1924* (2013.01)

(58) Field of Classification Search
None
See application file for complete search history.

(56) References Cited

U.S. PATENT DOCUMENTS

| | | | | |
|---|---|---|---|---|
| 4,721,295 | A | 1/1988 | Hathaway | |
| 5,088,707 | A | 2/1992 | Stemmler | |
| 5,730,695 | A | 3/1998 | Hauschild et al. | |
| 6,877,430 | B2 * | 4/2005 | Muller | B41F 21/104 101/490 |
| 7,037,251 | B2 | 5/2006 | Stefanoni | |
| 7,264,583 | B2 | 9/2007 | Gelli et al. | |
| 7,306,554 | B2 | 12/2007 | Couturier et al. | |
| 7,329,221 | B2 * | 2/2008 | Haasl | B65H 45/165 493/428 |

(Continued)

FOREIGN PATENT DOCUMENTS

| | | | |
|---|---|---|---|
| EP | 0982256 | A1 | 3/2000 |
| EP | 1640305 | A1 | 3/2006 |

(Continued)

*Primary Examiner* — Leslie A Nicholson, III
(74) *Attorney, Agent, or Firm* — Breiner & Breiner, L. L. C.

(57) ABSTRACT

The folding roller includes a rotation axis and at least a gripping member extending longitudinally along the folding roller, controlled by at least a piezoelectric actuator. The piezoelectric actuator causes a pivoting movement of the gripping member about its pivoting axis parallel to the rotation axis of the folding roller.

22 Claims, 11 Drawing Sheets

(56) References Cited

U.S. PATENT DOCUMENTS

| | | | |
|---|---|---|---|
| 2004/0089178 | A1 | 5/2004 | Muller et al. |
| 2005/0070418 | A1 | 3/2005 | Haasl et al. |
| 2005/0159286 | A1 | 7/2005 | Morelli et al. |
| 2007/0135287 | A1 | 6/2007 | Morelli et al. |

FOREIGN PATENT DOCUMENTS

| | | | |
|---|---|---|---|
| WO | 9728076 | A1 | 8/1997 |
| WO | 0162651 | A1 | 8/2001 |
| WO | 2004071921 | A1 | 8/2004 |
| WO | 2013029678 | A1 | 3/2013 |

* cited by examiner

FOLDING ROLLER AND MACHINE COMPRISING SAID ROLLER

TECHNICAL FIELD

The present invention relates to folding rollers for machines for converting sheet materials, for example and in particular—but not exclusively—tissue paper. The invention also relates to improvements to machines comprising folding rollers, for example interfolding machines, folding machines for producing packs of napkins, paper handkerchiefs and the like.

STATE OF THE ART

In many industrial fields it is necessary to fold sheets to produce packages, packs or stacks of folded sheets. For example, in the tissue paper converting industry, it is frequently necessary to fold sheets of tissue paper to produce paper handkerchiefs, napkins or the like. For this purpose, various types of folding machines and interfolding machines have been developed. These machines are usually provided with one or more folding rollers, which have gripping members for retaining the sheets to be folded, for example in a central area where the sheet must be folded.

Examples of prior art interfolding machines are illustrated in: EP1640305; EP0982256; DE4419989; U.S. Pat. No. 4,721,295; DE3927422; U.S. Pat. No. 7,306,554.

Examples of other prior art folding machines are disclosed in U.S. Pat. No. 7,037,251; EP1599404; U.S. Pat. No. 7,264,583; WO2004/071921; WO01/62651; WO97/28076; US2007/0135287; US2005/0159286.

All these types of folding machines require folding rollers provided with gripping members to mechanically retain the sheet in a central area, in which a fold must be formed. The gripping members are activated mechanically, in general with complex cam systems, synchronously with the angular position of the folding roller. These known systems are very complex, costly to produce and difficult to maintain. Moreover, they can be subject to failure and can be particularly noisy during operation.

Therefore, it would be beneficial to provide a folding roller that completely or partially overcomes the limits and the drawbacks of prior art folding rollers.

SUMMARY OF THE INVENTION

According to an aspect, there is provided a folding roller with a rotation axis, comprising a gripping member extending longitudinally along the folding roller, i.e., approximately parallel to the rotation axis thereof. Moreover, the roller comprises at least a piezoelectric actuator to control a pivoting movement of the gripping member about a pivoting axis thereof parallel to the rotation axis of the folding roller. The piezoelectric actuator can have small overall dimensions, high operating speeds and low inertia.

In advantageous embodiments the piezoelectric actuator comprises an active piezoelectric element and an amplification member of the deformations of the active piezoelectric element caused by a voltage applied to said active piezoelectric element. As described below, the amplification member can be a frame, typically in the form of a profile that surrounds the active piezoelectric element, defining an empty space inside the frame. The active piezoelectric element can be secured with two points, typically two ends of the active piezoelectric element, to two points of the frame, typically two opposite sides thereof.

With one or more piezoelectric actuators, which control a single gripping member, it is possible to obtain very fast movements and hence high production speeds, with considerable simplicity of synchronization of the movement of the folding members with the angular position of the folding roller.

In advantageous embodiments, the gripping member is housed in a longitudinal housing formed in a body of the folding roller. The material to be folded can be inserted partially into the longitudinal housing, for example with the aid of a suction system, or with a counter-blade or a wedge carried by a counter-roller. For example, it is possible to provide suction openings that generate a decrease in pressure in the longitudinal housing, preferably synchronously with the angular position of the folding roller. The web material, continuous or in sheets, is in this way sucked in along a line coinciding with an opening of the longitudinal housing and can be more easily engaged by the gripping member controlled by the piezoelectric actuator.

The gripping member can comprise one or more thin, preferably elastic plates carried on a bar or shaft parallel to the axis of the folding roller and housed for example in the longitudinal housing provided in the body of the folding roller and open on the cylindrical surface of the folding roller, forming a longitudinal slot, along which the gripping member acts on the material to be folded.

Depending on the type of use, the folding roller can have a plurality of gripping members, distributed along the circumferential extension of the folding roller.

In some embodiments, the folding roller can also have wedges or other members that facilitate forming the fold at a second folding roller, in the case in which two folding rollers are used in a pair in a folding machine and form a nip through which the continuous web or sheet material to be folded passes. In this case, during rotation in opposite directions of the two rollers, a gripping member and a wedge or other element that facilitates insertion of the web material in the housing in which the gripping member is housed, can be positioned opposite each other in the folding nip defined therebetween.

In some embodiments the piezoelectric actuator is connected to the gripping member by means of a thin elastic plate.

The piezoelectric actuator can be associated with one end of a shaft pivoting about its axis, parallel to the rotation axis of the folding roller. In some embodiments, each gripping member can comprise a shaft pivotally housed in a seat or housing of the folding roller and operated by two opposite piezoelectric actuators, which can advantageously be attached at opposite ends of the pivoting shaft. In this way, it is possible to obtain greater operating torques on each gripping member and consequently greater efficiency of the folding roller. The two piezoelectric actuators associated with each pivoting shaft are controlled so as to act synchronously.

According to a further aspect, there is provided a folding machine comprising at least a first feed path for feeding at least a first web material toward a folding unit, and members for forming packs of folded sheets produced from the web material. The folding unit comprises at least a folding roller as defined above. Preferably, the folding machine comprises a pair of folding rollers arranged with parallel axes to form a folding nip.

In some embodiments, the folding machine forms a continuous folded product, for example folded in a zig-zag. Preferably, the folding machine is adapted to form packs or stacks of products folded in sheets, i.e., individual sheets separate from one another and folded. The sheets can be superimposed or interfolded.

According to yet another aspect, there is provided a method for producing folded sheets of tissue paper, comprising the steps of: feeding a web material or a flow of sheets to a folding roller, comprising at least a gripping member extending longitudinally in a direction parallel to the axis of the folding roller; and controlling a cyclic movement of gripping and releasing of the gripping member by means of a piezoelectric actuator, to engage and release the web material or the sheets and facilitate the formation of folds in said web material or in said sheets.

Further advantageous embodiments and features of the folding roller and of the folding machine are described hereunder and defined in the accompanying claims.

BRIEF DESCRIPTION OF THE DRAWINGS

The invention will be better understood by following the description and accompanying drawings, which show a non-limiting example of embodiment of the invention. More in particular, in the drawing.

DETAILED DESCRIPTION OF EMBODIMENTS

Figure 1:
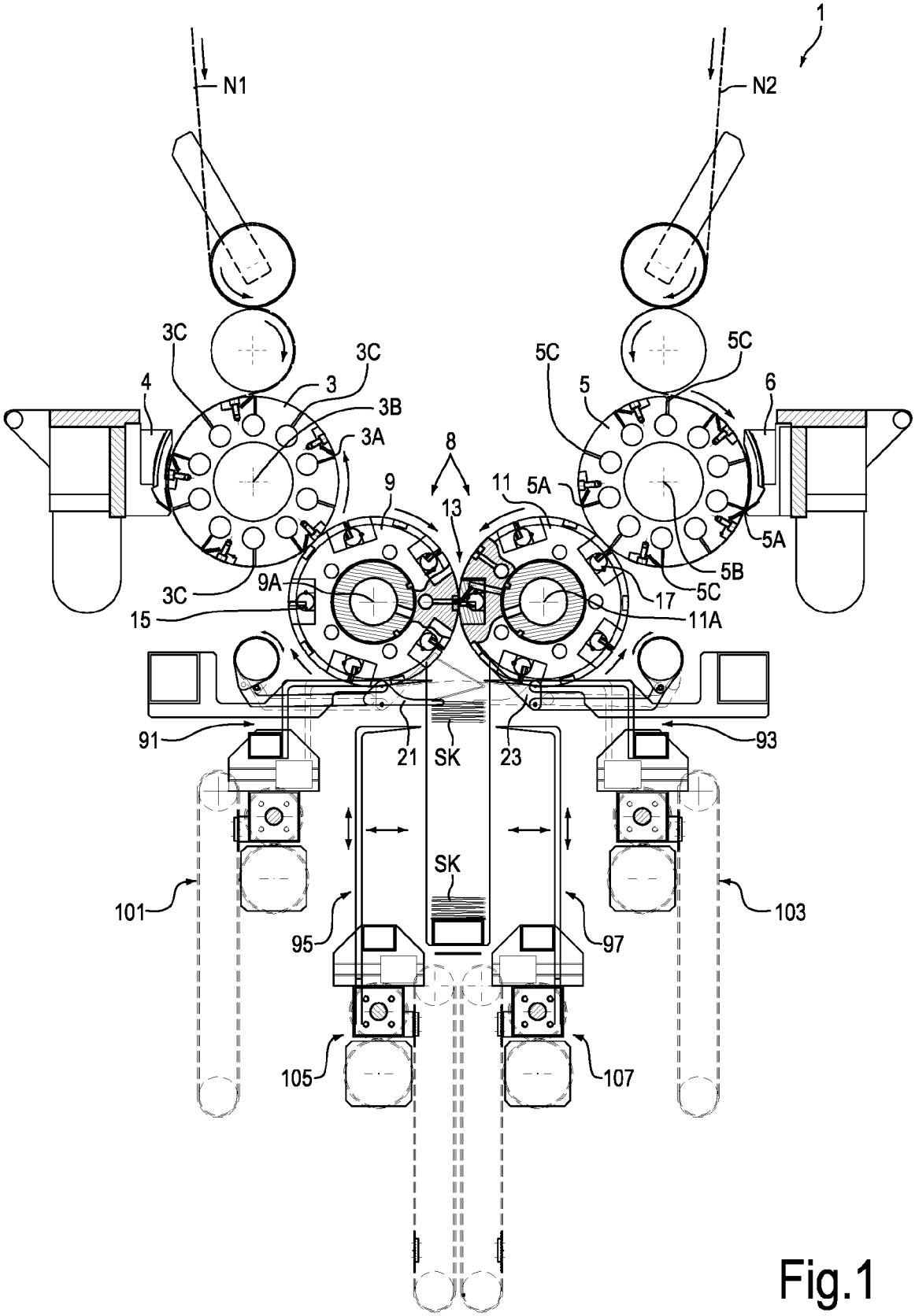
FIG. 1 shows a schematic front view of a folding machine configured as interfolding machine, in which a pair of folding rollers according to the present invention can be arranged.

The following detailed description of embodiments given by way of example refers to the accompanying drawings. The same reference numbers in different drawings identify identical or similar elements. Moreover, the drawings are not necessarily to scale. The following detailed description does not limit the invention. Rather, the scope of the invention is defined by the accompanying claims.

Reference in the description to "an embodiment" or "the embodiment" or "some embodiments" means that a particular feature, structure or element described in relation to an embodiment is included in at least one embodiment of the object described. Therefore, the phrase "in an embodiment" or "in the embodiment" or "in some embodiments" used in the description does not necessarily refer to the same embodiment or embodiments. Furthermore, the particular features, structures or elements may be combined in any appropriate manner in one or more embodiments.

In practice, to fold a sheet material or a continuous web material, a folding roller is provided that has, on its cylindrical surface, one or more gripping members, configured to engage a sheet or a web material, fed to the folding roller, at a line along which a fold must be formed. To retain the sheet or the web material to be folded, the gripping member is operated by means of at least a piezoelectric actuator that causes a movement of the gripping member, synchronized with the angular position of the folding roller. The movement of the gripping member, controlled by the piezoelectric actuator in phase with the angular position of the folding roller, causes gripping and subsequent release of the web material or of the sheet.

The folding roller can be equipped with a plurality of such gripping members, each provided with its own piezoelectric actuator, or also with several piezoelectric actuators, if required. The piezoelectric members can be energized by means of a rotary electrical joint mounted on one end of the roller.

Through the use of piezoelectric actuators, control of the, or of each, gripping member is obtained in a rapid and precise manner, easily synchronizable with the angular position of the folding roller. Compared to prior art rollers, the roller that is obtained is simple, of easy construction, lighter and quieter during operation. Electrical control with electronic operation of the piezoelectric actuators enables high operating speeds to be achieved, if required.

As will be apparent from the description below, the folding roller can be used in a plurality of different applications, on folding machines of various configuration, for example on interfolding machines. In general, the folding roller can be used to process a continuous web material, which can be cut after folding. In other uses, the folding roller can operate on a discrete flow of sheets, obtained by cutting a continuous web material, which is divided into said sheets upstream of the folding roller.

In some embodiments, folding rollers of the type described here can be used in pairs, each pair forming a nip for the web material or the sheets of pre-cut web material to pass through.

With reference to the drawings, FIG. 1 illustrates a front view of an interfolding machine 1, which can be equipped with folding rollers according to the present invention. The interfolding machine 1 of FIG. 1 is shown purely by way of example and purely for the purpose of illustrating a possible use of the rollers of the invention. The configuration of the interfolding machine can change with respect to what is described herein by way of example. Moreover, as will be more apparent below, the features of the folding rollers according to the invention can also be usefully and advantageously used in folding machines or other machines for converting products in sheets, particularly in machines for converting paper, for example tissue paper.

In the embodiment of FIG. 1, the interfolding machine 1 comprises a first feed path for a first continuous tissue paper web material N1 and a second feed path for a second continuous tissue paper web material N2. Arranged along the first path is a first rotating cutting roller 3, which is provided with angularly spaced blades 3A. The blades 3A coact with a first stationary counter-blade 4. Arranged along the second path is a second rotating cutting roller 5, which is provided with angularly spaced blades 5A. The blades 5A coact with a second stationary counter-blade 6. The first cutting roller 3 rotates about a first rotation axis 3B and the second roller 5 rotates about the second rotation axis 5B.

Moreover, the first cutting roller 3 is provided with suction openings 3C along the cylindrical surface thereof. The second cutting roller 5 is in turn provided with suction openings 5C along the cylindrical surface thereof. The suction openings 3C, 5C are adapted to retain, on the surface of the respective cutting rollers 3, 5, the sheets produced by cutting the first and the second continuous web material N1, N2, and to transfer said sheets from the cutting rollers 3, 5 to a folding unit 8, which can comprise two folding rollers 9, 11 substantially parallel with each other.

The folding rollers 9, 11 rotate about respective rotation axes 9A, 11A, parallel to each other and parallel to the rotation axes of the cutting rollers 3, 5. The two folding rollers 9, 11 form an interfolding nip 13. Each folding roller 9, 11 is provided with respective gripping members 15, 17. The gripping members 15, 17 will be described in greater detail below.

Each continuous web material N1, N2 is guided around the respective rotating cutting roller 3, 5 and is fed between the cutting roller 3, 5 and the stationary counter-blade 4, 6. The rotating blades 3A coact with the stationary counter-blade 4 to cut the continuous web material N1 into individual sheets, which are then transferred from the first cutting roller 3 to the first folding roller 9. Likewise, the continuous web material N2 is guided around the second cutting roller 5 and cut into sheets by the rotating blades 5A coacting with the stationary counter-blade 6. The individual sheets are then moved from the second cutting roller 5 to the second folding roller 11.

A first series of separating fingers 21 is associated with the first folding roller 9. A second series of separating fingers 23 is associated with the second folding roller 11.

In preferred embodiments, the first and the second series of separating fingers 21, 23 move synchronously with the gripping members 15, 17, so that when a gripping member is releasing a folded sheet, the separating fingers 21 or 23 detach or help to detach the folded sheet from the respective folding roller 9, 11.

In other embodiments, the interfolding machine 1 may not be equipped with separating fingers 21, 23. In this case, the sheets are released only when the gripping members 15, 17 are opened.

Operation of the interfolding machine 1 is in general known in the art and does not require detailed description. The two folding rollers 9, 11 and the series of separating fingers 21, 23 coact to produce stacks of interfolded sheets, one of which is shown schematically in FIG. 2 and indicated with SK. Sheets S1 are fed from the first folding roller 9 and sheets S2 are fed from the second folding roller 11. Each sheet S1 has a central folding line F1, which divides the sheet S1 into two halves. Each sheet S2 has a central fold line F2, which divides the sheet S2 into two halves. The sheets S1, S2 are interfolded or intercalated, in the sense that each half portion of a sheet S1 is arranged between two half portions of a sheet S2 and vice versa. Half portions of two consecutive sheets S1 are arranged between two half portions of each sheet S2. Likewise, half portions of two consecutive sheets S2 are positioned between two half portions of each sheet S1. In this configuration, a folded sheet contains the trailing end of the preceding sheet and the leading end of the subsequent sheet, thereby forming a stack SK of interfolded sheets.

In order to form stacks of interfolded sheets S1, S2 containing a predetermined number of sheets, a first pair of counting combs 91, 93 and a second pair of counting combs 95, 97 can be provided.

Each counting comb is movable according to a first direction and according to a second direction along two translation axes X and Y. The axis X is orthogonal to the rotation axes 9A, 11A of the folding rollers 9, 11 and parallel to a plane that contains the rotation axes 9A, 11A. The axis Y is orthogonal to the axis X and to the rotation axes 9A, 11A. The movement according to the axes X and Y is controlled individually for each counting comb, 93, 95 and 97, as each counting comb has its own control unit. However, these movements are synchronized and coordinated with each other, in order to form sequences of stacks of interfolded sheets. The control units of the counting combs 91, 93, 95, 97 are labeled 101, 103, 105 and 107, respectively. The control units can be interfaced with a single control unit, so that their movements can be synchronized.

General operation of the interfolding machine 1 is known to those skilled in the art and is not described in detail. For the purposes of the present description, it is significant that the gripping members 15, 17 of the two folding rollers 9 and 11 must be operated synchronously with the angular position of the folding rollers, so that each gripping member 15, 17 engages a central portion of the respective sheet S1, S2 when the gripping member is approximately in the interfolding nip 13, so that the sheet retained in the central area is folded along the folding line F1 or F2 (FIG. 2) before being detached from the respective folding roller 9, 11.

The folding rollers 9, 11 have an innovative structure and features, which will be described below. Folding rollers with similar innovative features can also be used in other types of folding machines, different from the interfolding machines, of which FIG. 1 shows an exemplary embodiment.

Figure 2:
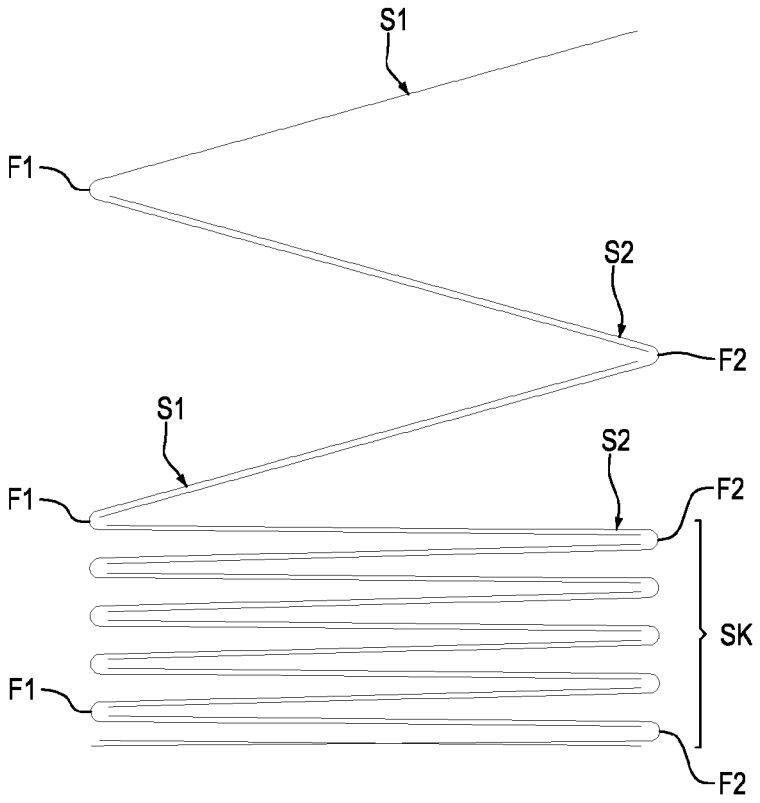
FIG. 2 shows a schematic view of a stack of interfolded sheets produced with the machine of FIG. 1.

For example, FIG. 2 illustrates a folding machine 200 for producing a stack of folded sheets F that can be packaged in single packs or packages. The folding machine 200 comprises a feed path, represented by the arrows P, for a web material N, comprising one or more plies of tissue paper. The web material N can be fed from one or more parent reels, not shown.

Arranged along the feed path P is a folding plate 201 along which the web material N is folded along a longitudinal central line. Pairs of guide rollers 203, 205 are arranged downstream of the folding plate 201. Each pair of guide rollers comprises two rollers with substantially parallel and vertical axes, in the drawing. A folding unit 8 and a transverse cutting tool 207 are positioned downstream of the guide rollers 203, 205. The folding unit comprises a pair of folding rollers 9, 11 (only one of which is visible in FIG. 3), which fold the web material in a zig-zag. The transverse cutting tool 207, which cuts the web material folded in a zig-zag into two parallel stacks of folded sheets F, is positioned downstream of the folding rollers 9, 11. Groups of folded sheets are picked up from the machine and packaged.

Folding machines of this type are disclosed, for example, in U.S. Pat. No. 7,264,583; WO2004/071921; WO01/62651; WO97/28076.

The folding rollers 9, 11 can be designed as described below with reference to FIGS. 4 to 9.

Figure 3:
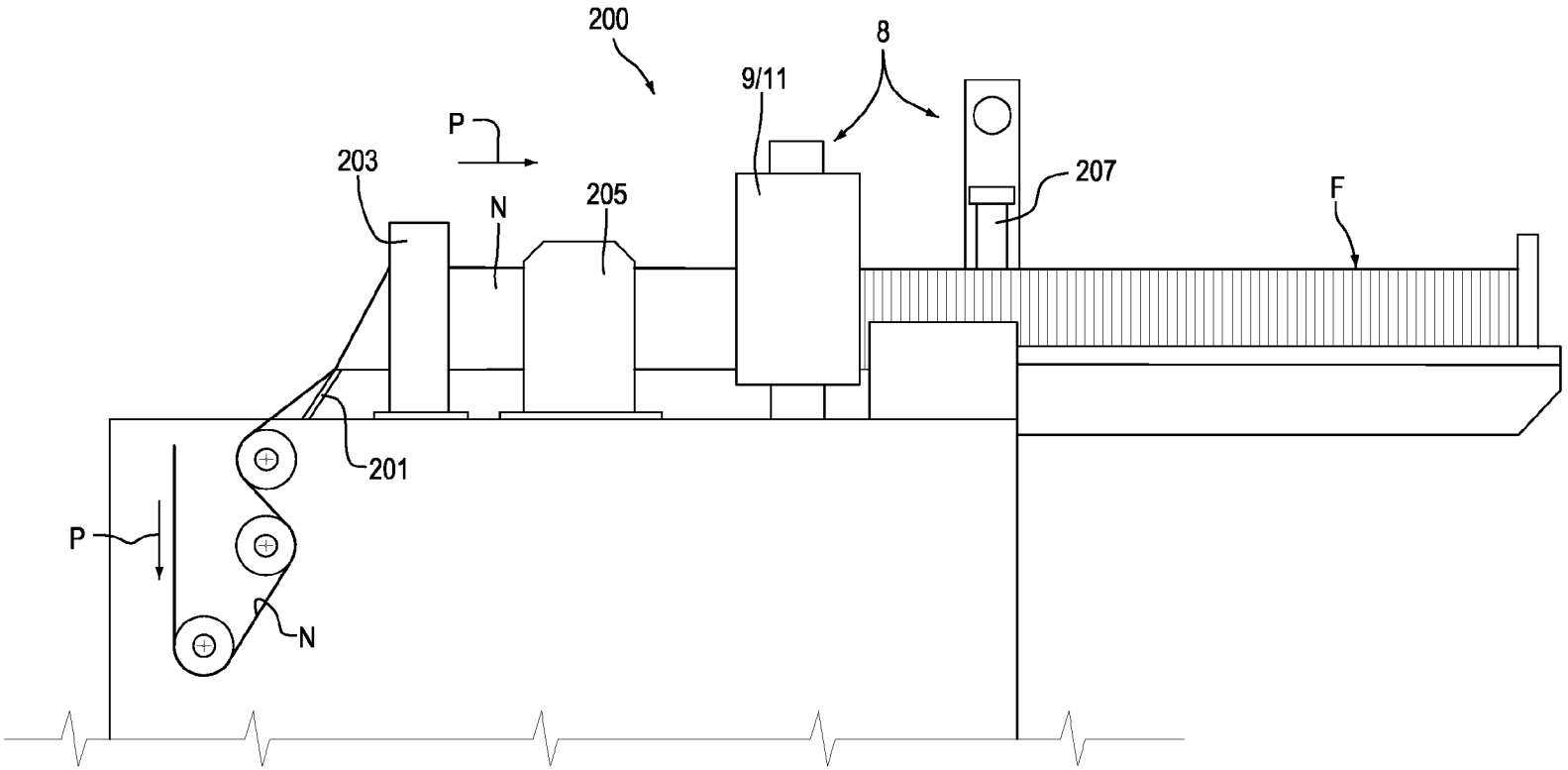
FIG. 3 shows a schematic side view of another embodiment of a folding machine, in which folding rollers of the present invention can be used.
Figure 4:
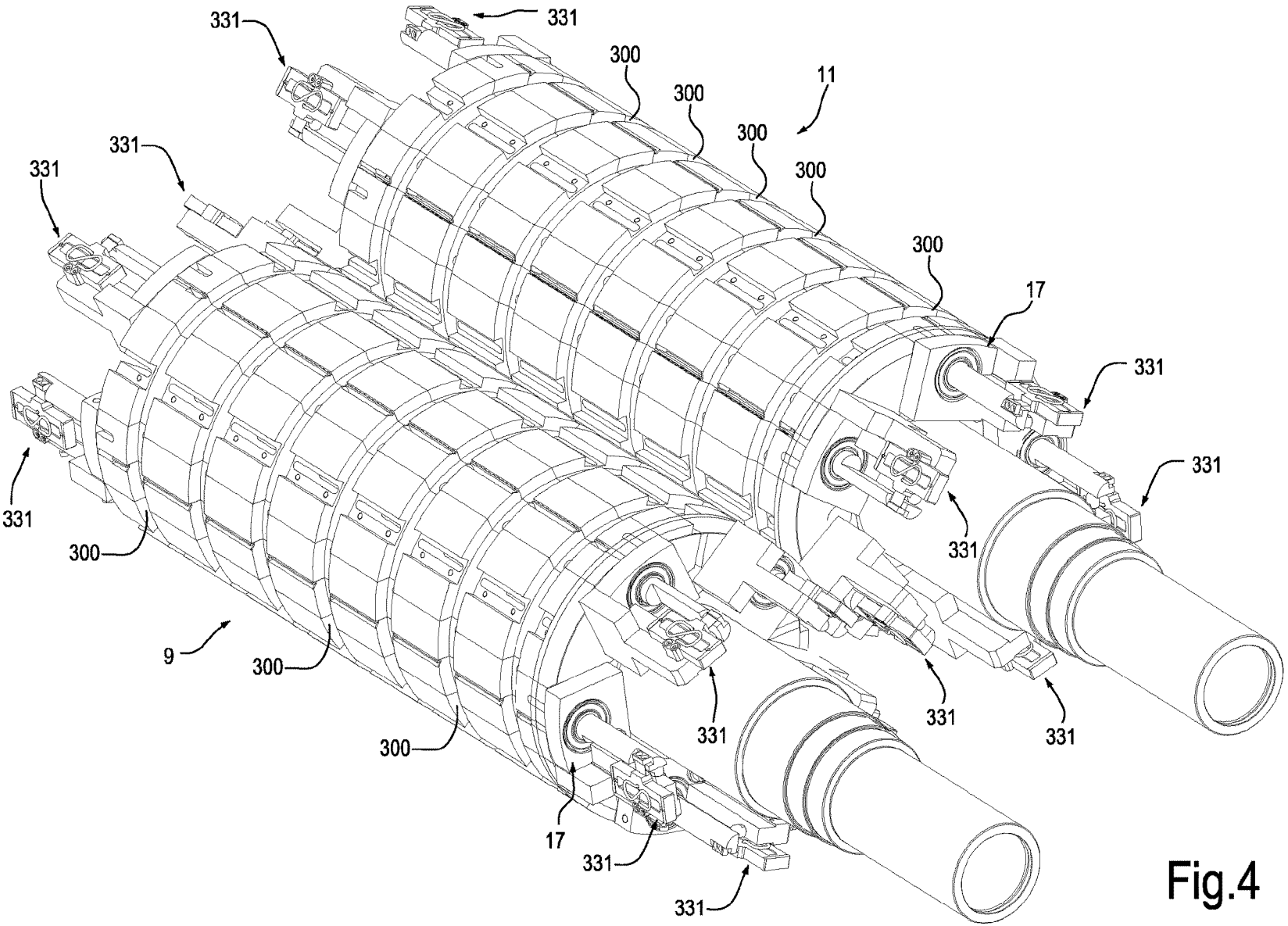
FIG. 4 shows an axonometric view of a pair of folding rollers.
Figure 5:
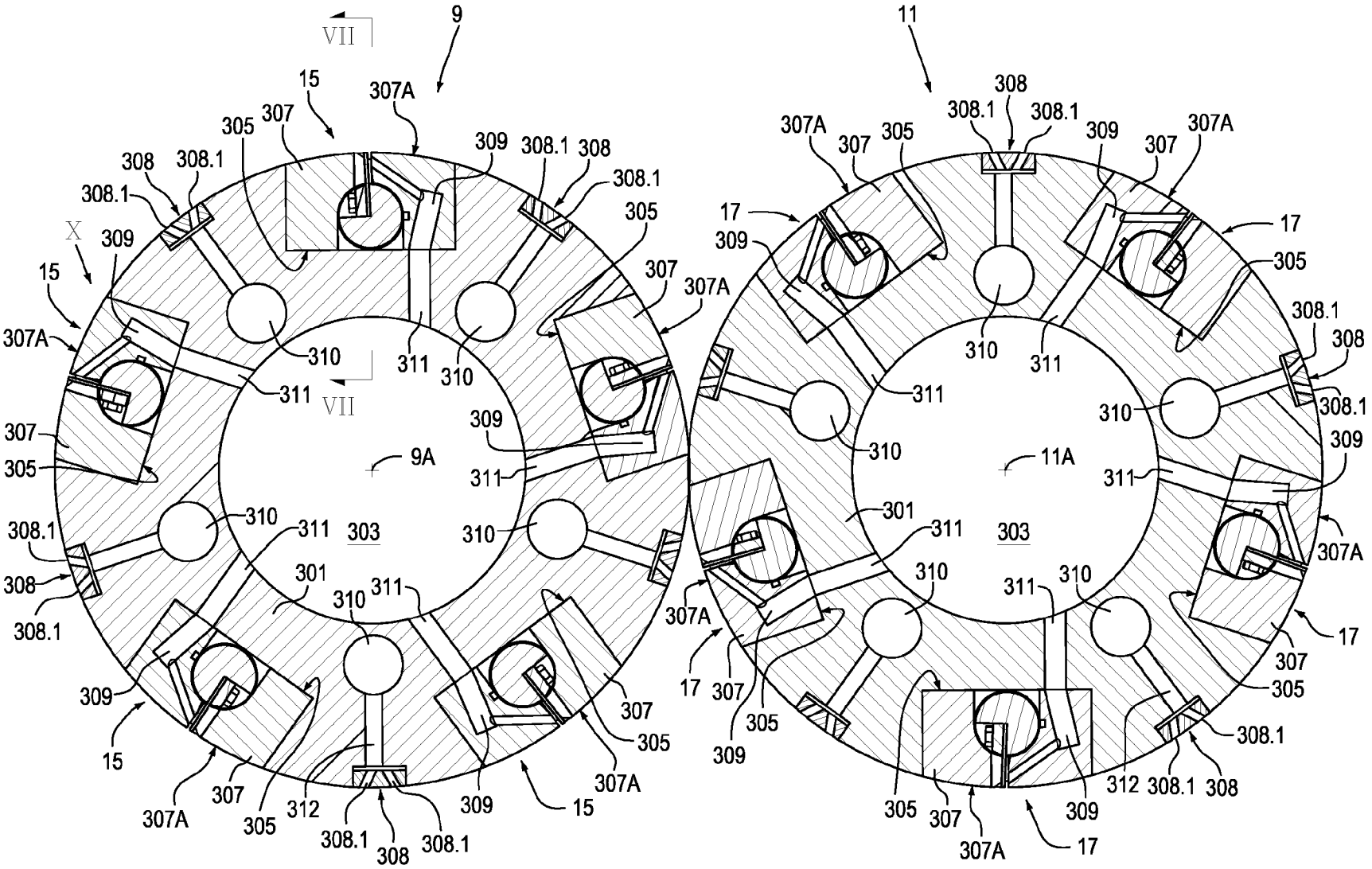
FIG. 5 shows a cross section, according to a plane orthogonal to the rotation axes of the folding rollers of FIG. 4.

FIG. 4 shows an axonometric view of a pair of folding rollers 9, 11 and FIG. 5 shows a cross section according to a plane orthogonal to the rotation axes 9A, 11A of the folding rollers. The folding rollers 9, 11 are shown in the position that they can have in the folding machine, for example in the folding machine or interfolding machine 1 of FIG. 1 or in the folding machine 200 of FIG. 3. The two folding rollers 9, 11 have structures substantially identical to each other. They can, for example, be symmetrical. Identical elements of the two folding rollers 9, 11 are designated with the same reference numbers.

In some embodiments, each folding roller 9, 11 can have annular grooves 300, in which separating fingers 21, 23, described above, can engage.

According to some embodiments each folding roller 9, 11 can comprise a core or body 301 (see in particular FIG. 5), which can have a substantially cylindrical axial cavity 303. Each cylindrical cavity 303 can be in communication with a suction system, for example a pump or a suction fan. According to some embodiments, the core 301 of each folding roller 9, 11 comprises a plurality of seats 305 which extend parallel to the respective rotation axes 9A, 11A and that face the outside of the core or body 301. A respective gripping member 15 or 17 is inserted into each seat 305.

Figure 7:
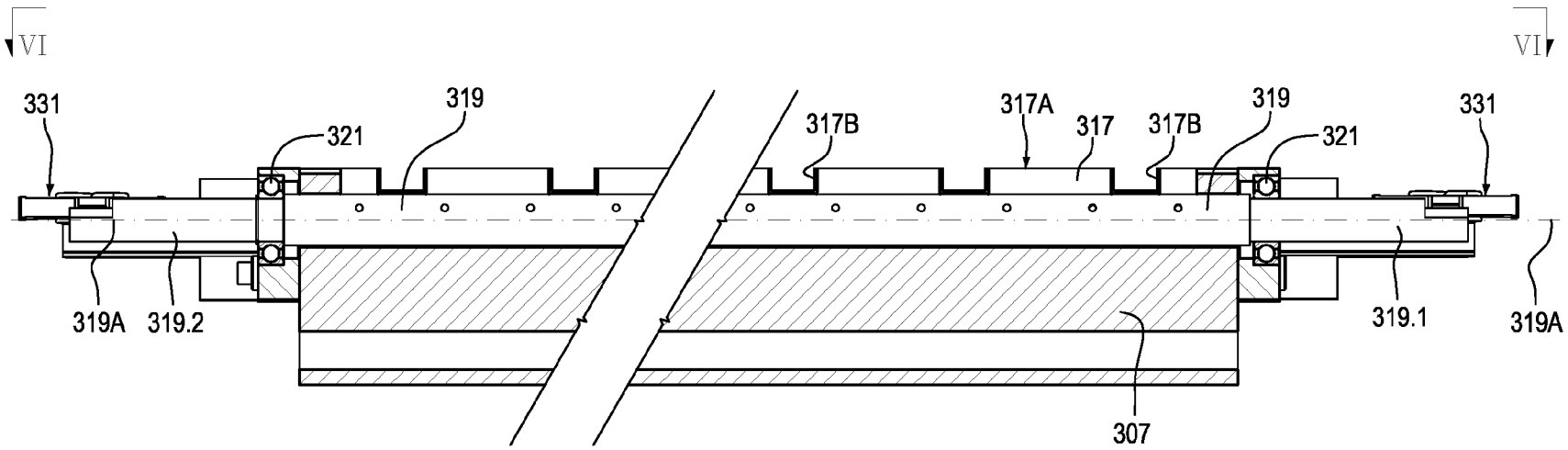
FIG. 7 shows a sectional view along the line VII-VII of FIG. 5.
Figure 8:
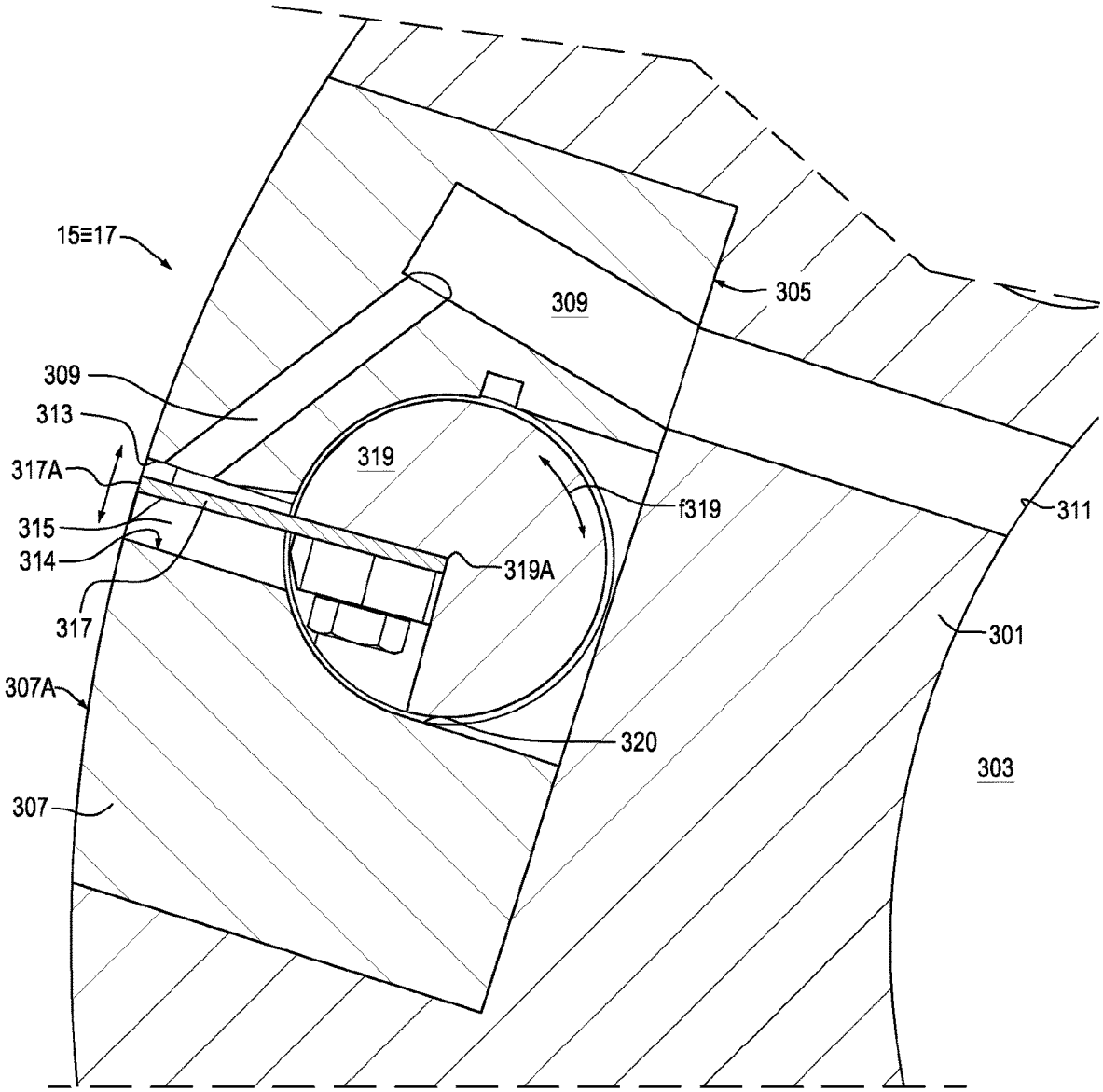
FIG. 8 shows an enlargement of a detail of FIG. 5.

Continuing to refer to FIGS. 4 and 5, a gripping member 15, 17 housed in its seat 305 is shown in the enlargement of FIG. 8 and is further illustrated separate and isolated from the respective folding roller 9, 11 in FIG. 7, in a longitudinal sectional view. Each gripping member 15, 17 can comprise a bar or beam 307 mounted in the respective seat 305 and which extends parallel to the axis 9A, 11A of the respective folding roller 9, 11. Each bar has an outer surface 307A. The surfaces 307A of the various bars 307 form, together with the core 301, the outer cylindrical surface of the respective folding roller 9, 11.

In addition to the beams or bars 307, FIG. 5 also shows inserts 308, omitted in FIG. 4, which have arrays of suction holes 308.1, in communication with a suction duct 310 (in the example illustrated, one for each insert 308), provided in the core 301 of the respective roller. A suction hole that places the holes 308.1 in communication with the suction duct 310 is indicated with 312. In a manner known per se, the purpose of the suction holes 308.1 is to retain the two transverse edges of each sheet of web material to be folded on the surface of the respective folding rollers 9, 11. The inserts 308 are omitted in the axonometric view of FIG. 4, where the seat in which the single inserts 308 are inserted is visible. The inserts are spaced from one another to leave the annular grooves 300 free.

In some embodiments, each beam or bar 307 is equipped with a series of ports 309 distributed along the longitudinal extension, i.e., along the direction of the rotation axis 9A, 11A, of the bar 307. One of these ports 309 of one of the bars 305 is clearly visible in the enlargement of FIG. 8. Each port 309 can be in fluid communication with the inner cavity 303 of the respective core 301 of the folding roller 9, 11, through a respective hole 311. The various ports 309 of each bar 307 lead out onto a wall 313 of a slot 315 extending longitudinally along the beam 307. The slot 315 is open on the cylindrical surface of the respective folding roller 9, 11 and is delimited, in addition to the wall 313, by a further wall 314 parallel thereto.

Each gripping member 15, 17 comprises a pressing member 317, adapted to coact with the wall 313 and to press against it, in the manner and for the purposes described below. In some embodiments, the pressing member 317 can consist of, or comprise, a thin sheet or plate, made of elastic material, for example a metal material or other sufficiently hard elastic material. In some embodiments each gripping member 15, 17 comprises a single thin sheet or plate that extends for the whole of the axial extension of the beam or bar 307. The thin sheet 317 can have an outer edge 317A located in the mouth of the slot 315, i.e., substantially approximately on the cylindrical surface of the folding roller 9, 11, and more precisely approximately on the portion of cylindrical surface 307A of the bar 307. In some embodiments, the edge 317A can be slightly inside the cylindrical surface 307A, or slightly outside the cylindrical surface 307A of the respective bar 307. To allow the fingers 21, 23 to penetrate the annular grooves 300 without obstruction, the thin sheet 317 can have indentations 317B aligned with the portions of groove 300 formed by the respective bar 307, as is visible in particular in FIG. 7.

In other embodiments, the pressing member consists of a plurality of thin sheets 317 aligned with, and spaced apart from, one another, so as to leave the annular grooves 300 free.

The thin sheet or sheets 317 can be mounted on a moving supporting member, which controls their movement toward and away from the wall 313. In some embodiments, the thin sheet or sheets forming each pressing member 317 can be fixed on a shaft 319.

Each shaft 319 is provided with a pivoting motion about an axis 319A, parallel to the axis 9A or 11A of the respective folding roller 9, 11. The pivoting movement is imparted by one or more piezoelectric actuators, as described below.

In some embodiments, each shaft 319 can be supported by two bearings 321 mounted at opposite ends of the beam or bar 307, visible in particular in the section of FIG. 7. Each shaft 319 can project toward the outside of the respective bearings 321 with opposite ends of shaft 319.1 and 319.2. Each shaft 319 can be housed in a longitudinal housing 320 formed in the respective bar 307, visible in particular in the enlarged section of FIG. 8.

At least one of the two ends 319.1 and 319.2 can be associated with a piezoelectric actuator. In some embodiments, as shown in the accompanying drawings, each shaft 319 is associated with two piezoelectric actuators 331, one for each end of shaft 319.1 and 319.2. The piezoelectric actuators are indicated with 331. The two piezoelectric actuators 331 at the two ends of each shaft 319 can be substantially identical. One of them is shown in an enlarged axonometric view in FIG. 6.

Figure 6:
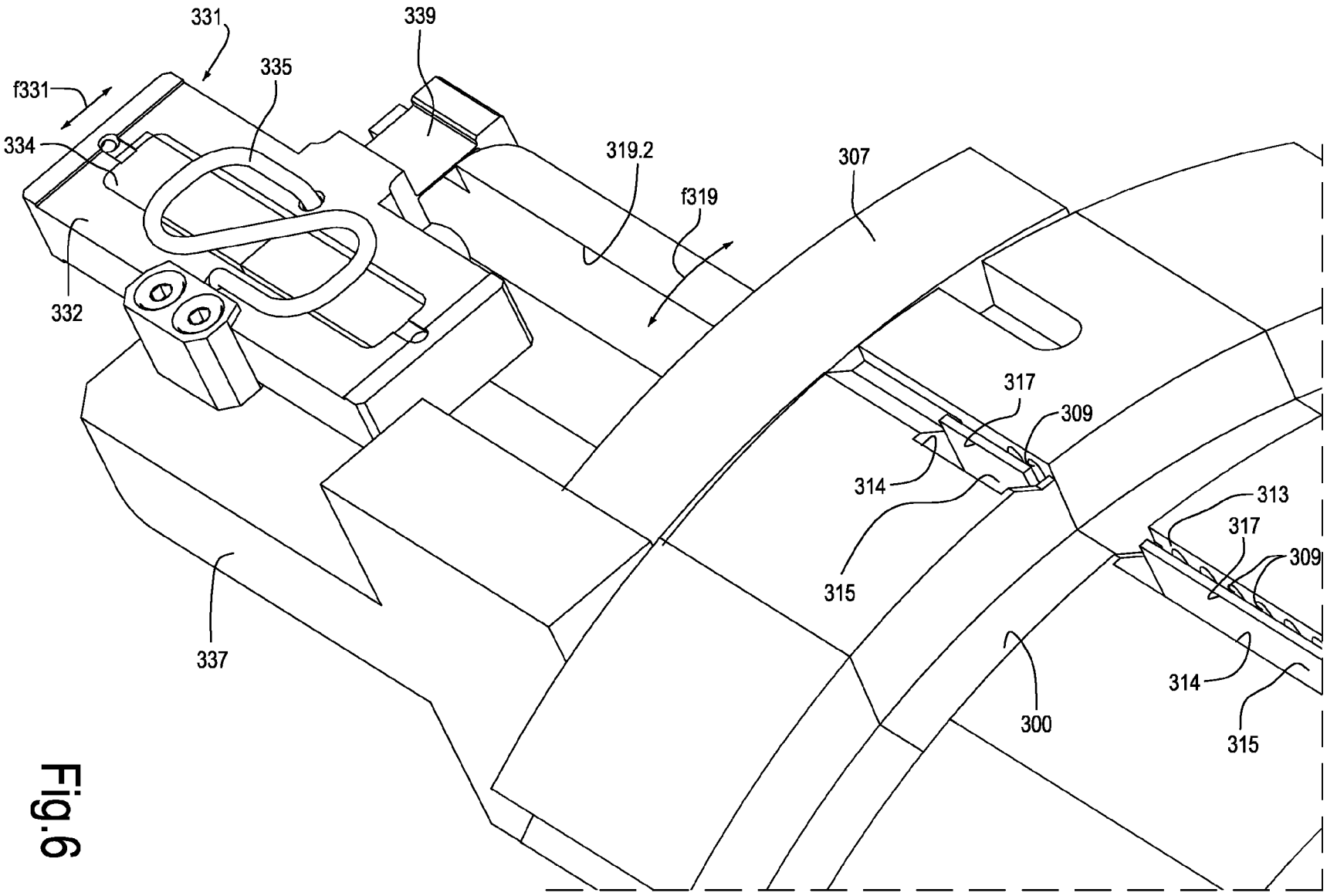
FIG. 6 shows an enlargement of a detail of FIG. 4.

In some embodiments, the piezoelectric actuator can comprise an active piezoelectric element 334 contained in a deformable frame 332 (see FIG. 6). The frame 332 is preferably elastically deformable. Therefore, it will be referred to hereunder as elastically deformable frame 332.

The active piezoelectric element 334 is made of a material having piezoelectric properties, or can contain at least one part made of material having piezoelectric properties. Piezoelectricity is the property of some crystalline materials to polarize, generating a potential difference when they are subjected to mechanical deformation (so-called direct piezoelectric effect), and at the same time to become elastically deformed if subjected to an electric potential difference (so-called inverse piezoelectric effect).

Each elastically deformable frame 332 is equipped with an elastic return member, for example a spring 335 and is fixed on a respective bracket 337, mounted on the bar 307. Each elastically deformable frame 332 is connected by means of a thin plate 339 to the respective ends 319.1 or 319.2 of the shaft 319.

In some embodiments, as shown in FIG. 6, the elastically deformable frame 332 can have a substantially rectangular shape, in the form of a closed frame, with two longer sides and two shorter sides. The active piezoelectric element 334 can be housed inside the space defined by the elastically deformable frame 332, i.e., between the two longer sides and the two shorter sides. This element can be secured by means of two ends to two opposite sides of the elastically deformable frame 332, for example to the two shorter sides. The thin plate 339 that connects the elastically deformable frame 332 to the shaft 319 can be secured to a long side of the elastically deformable frame 332.

In general, the thin plate 339 can be fixed to a side of the elastically deformable frame 332 orthogonal to the sides thereof to which the active piezoelectric element 334 is connected. The elastic return member 335 can be adapted to act on two sides of the elastically deformable frame 332 orthogonal to the sides to which the ends of the active piezoelectric element are secured, in the example of FIG. 6 to the two longer sides of the elastically deformable frame 332.

Applying a voltage to the active piezoelectric element 334, an elastic deformation thereof through inverse piezoelectric effect is caused. As the deformation is very slight, it is amplified by the elastically deformable frame 332. The deformation of the frame 332 is transmitted by means of the thin plate 339 to the end 319.1 or 319.2 of the shaft 319. In FIG. 6 the double arrow f331 indicates the movement caused by the piezoelectric actuator 331. The direction of the movement is oriented at 90° with respect to the direction of the axis 319A of the shaft 319. The forces applied by the two piezoelectric actuators 331 at the two ends of the shaft 319 in this way cause a rotation movement of the shaft 319 about the axis 319A thereof, as a result of the contraction and expansion of the active piezoelectric element 334 of the two piezoelectric actuators 331. By applying periodically variable electric potential to the ends of the active piezoelectric elements 334 of the two piezoelectric actuators 331 it is thus possible to cause a pivoting motion of the shaft 319, according to the double arrow f319 shown in FIG. 6.

The frames 332 allow the movement to be appropriately amplified obtaining a suitable angular displacement of the shaft 319. The use of two piezoelectric actuators 331 at the two ends of the shaft 319 ensure sufficient torque on the shaft 319. It would also be possible to use a single piezoelectric actuator 331, or even more than two piezoelectric actuators 331, for example adding a piezoelectric actuator in a central position along the extension of the respective folding roller 9, 11, in a specific seat provided therein (not shown).

The folding rollers 9, 11 designed as described above can be used in any machine in which it is necessary to engage a sheet along a folding line, for example in folding machines and interfolding machines as described with reference to FIGS. 1 to 3 and in the prior art publications mentioned above.

Figure 9A:
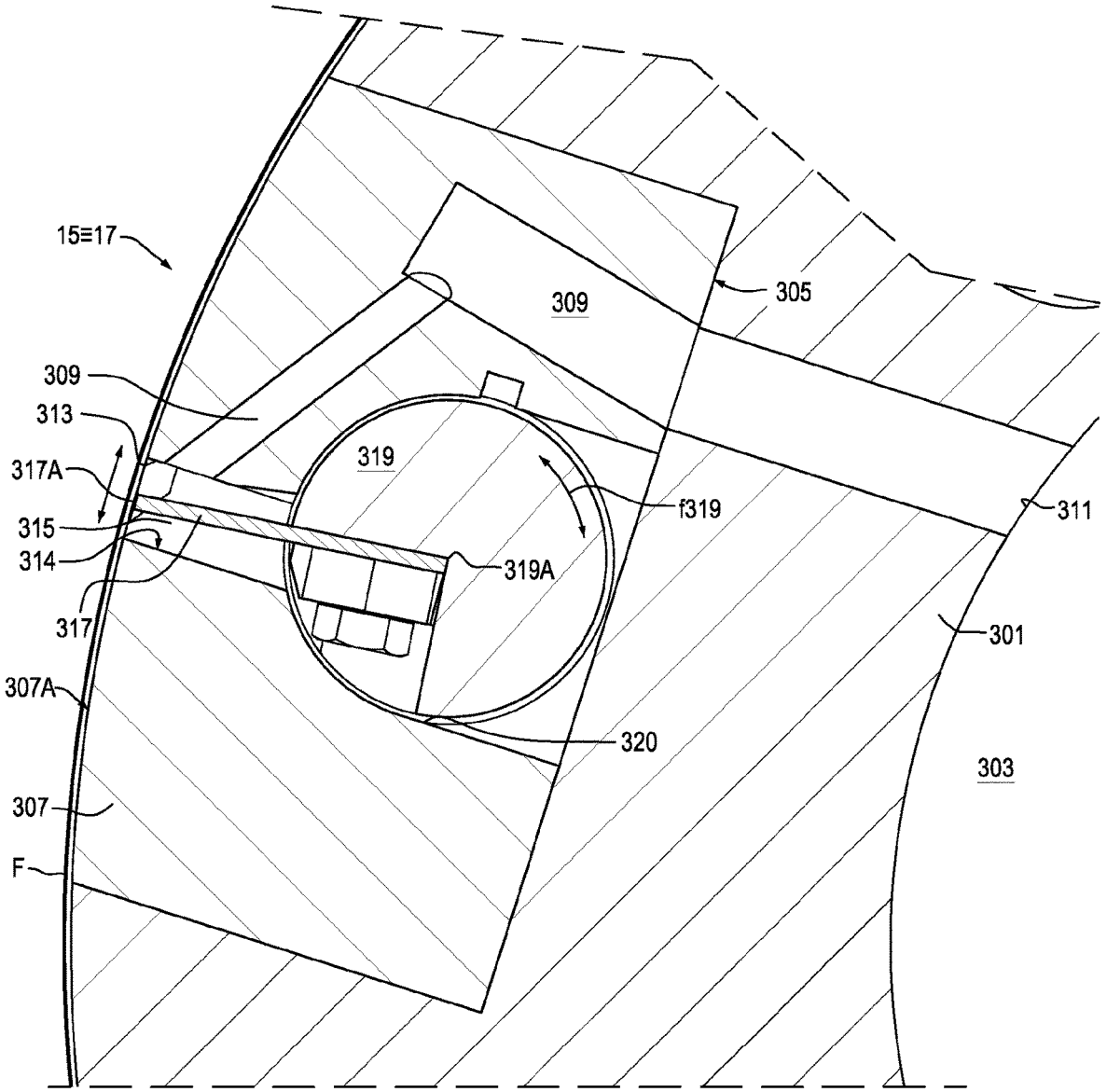
FIGS. 9A, 9B, 9C show an operating sequence of one of the gripping devices of a folding roller.
Figure 9B:
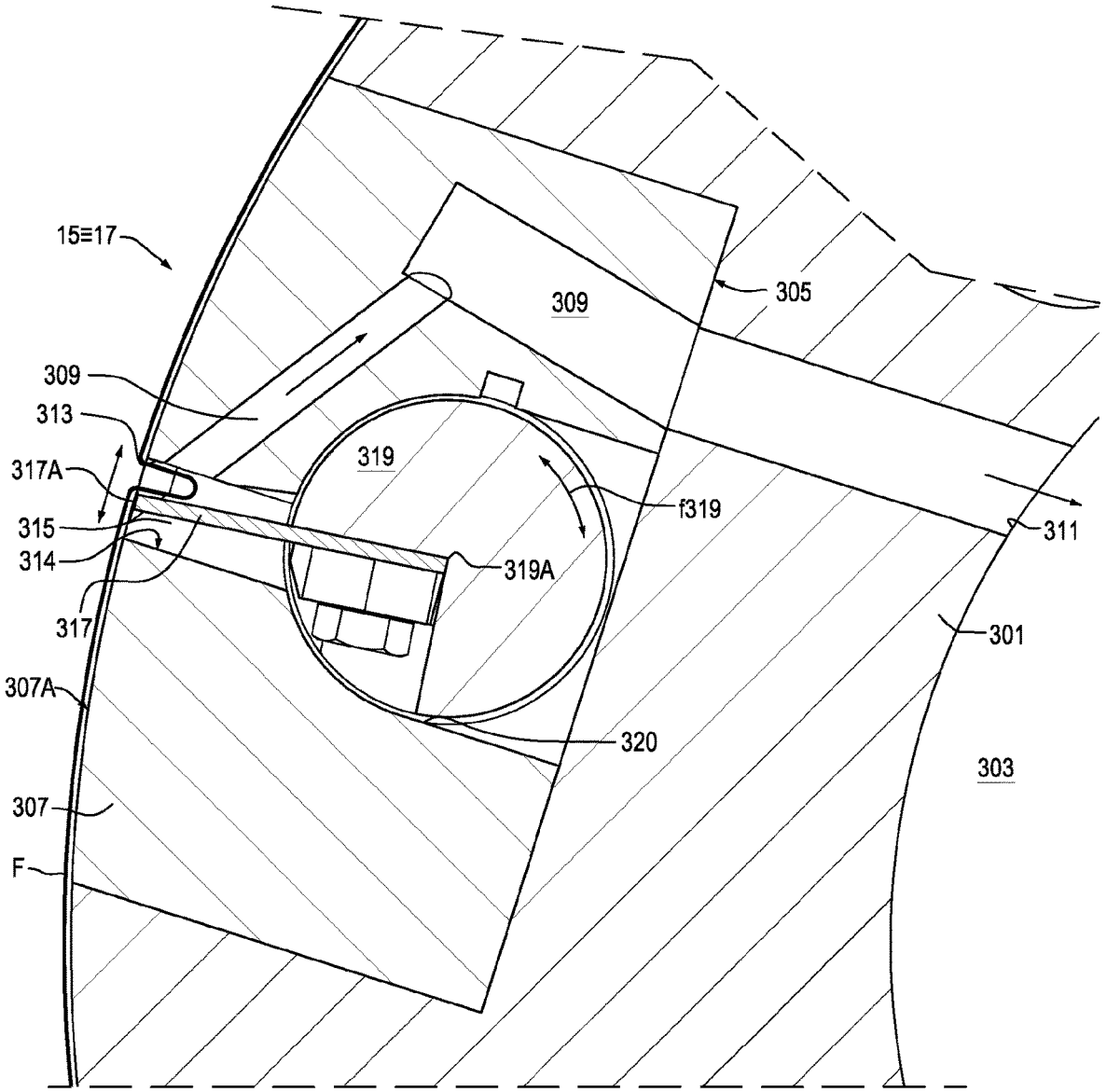
Figure 9C:
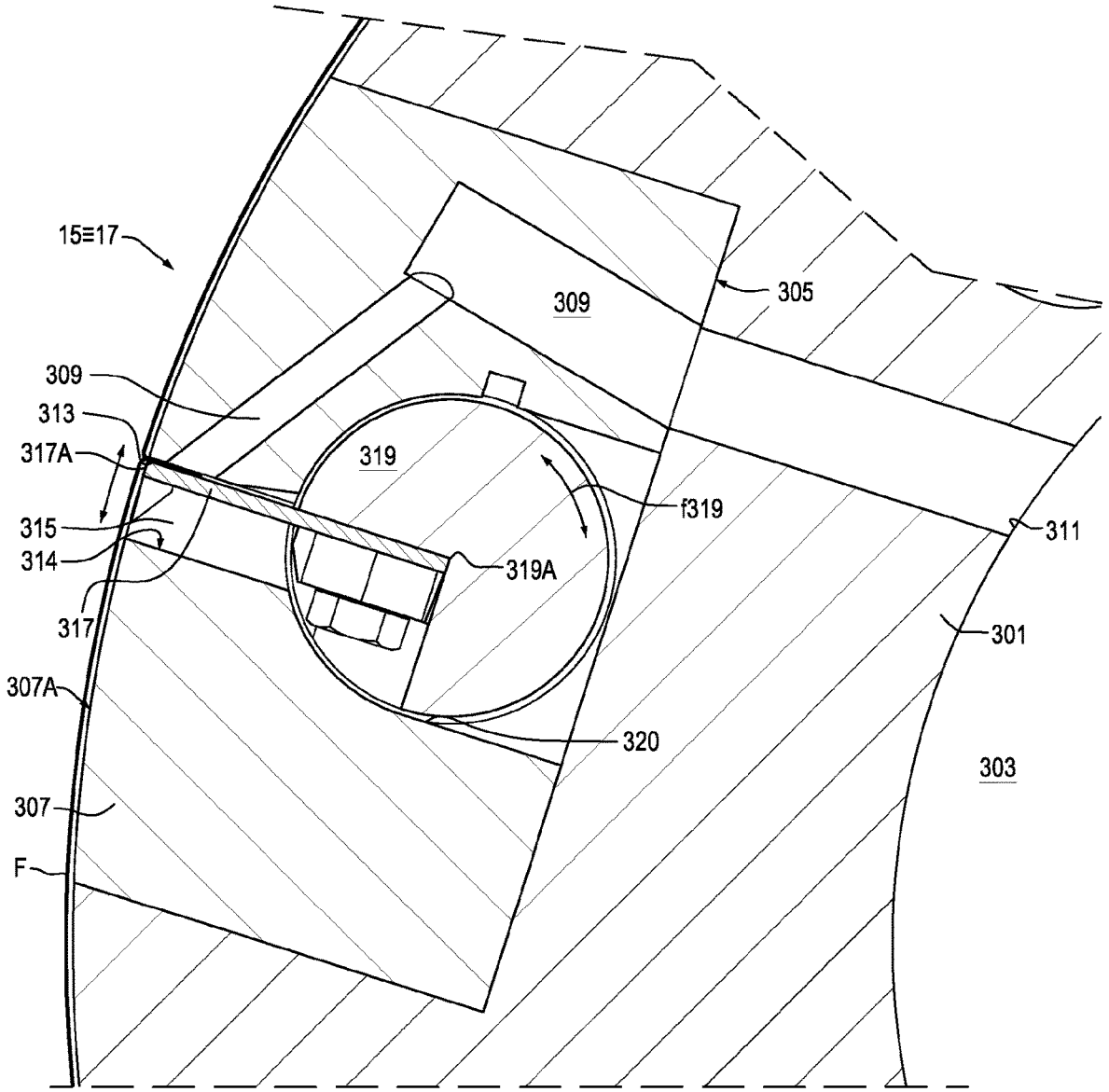

Operation of each folding roller is as follows. The sheet material is placed on the cylindrical surface of the respective folding roller and covers at least one of the gripping members 15, 17. A suction through the openings 309 causes a decrease of pressure in the slot 315, while the thin plate 317 is in an angular position spaced with respect to the wall 313, as shown in FIG. 9A. The suction helps the sheet to at least partially penetrate the slot 315, forming a fold (FIG. 9B). Subsequently, the shaft 319 pivots under the control of the piezoelectric actuators 331 and grips the folded portion of the sheet material between the thin plate 317 and the wall 313 of the slot 315 (FIG. 9C). The aforesaid operations are synchronized with the rotation movement of the folding roller. The sheet folded and retained by the thin plate 317 is then released, once again in a manner synchronized with the angular position of the folding roller 9, 11, by means of the action of the piezoelectric actuators 331, which cause a rotation of the shaft 319 in reverse direction, thus releasing the folded sheet.

The operations of the folding member described above are coordinated in a manner known per se with the other operations of the folding machine in which the respective folding roller is inserted. These operations are known per se to those skilled in the art and do not require to be described herein.

The invention claimed is:

1. A folding roller with a rotation axis, comprising at least one gripping member extending longitudinally along the folding roller and at least one piezoelectric actuator for controlling a pivoting movement of the at least one gripping member about a pivoting axis thereof parallel to the rotation axis of the folding roller; and wherein said at least one piezoelectric actuator comprises an active piezoelectric element contained in an amplification member, wherein deformations of the active piezoelectric element caused by a voltage applied to said active piezoelectric element are amplified to obtain desired displacement of the piezoelectric actuator.

2. A folding roller with a rotation axis, comprising at least one gripping member extending longitudinally along the folding roller and at least one piezoelectric actuator for controlling a pivoting movement of the at least one gripping member about a pivoting axis thereof parallel to the rotation axis of the folding roller; and wherein said at least one piezoelectric actuator comprises an active piezoelectric element contained in an amplification member of deformations of the active piezoelectric element caused by a voltage applied to said active piezoelectric element, wherein the amplification member comprises a deformable frame, which amplifies the deformations of the active piezoelectric element caused by an electrical voltage applied to said active piezoelectric element.

3. The folding roller of claim 2, wherein the deformable frame is a closed frame comprising a plurality of sides joined to one another to form a frame that defines a volume in which the active piezoelectric element is housed, said deformable frame having a rectangular shape, and said active piezoelectric element being secured to two points of the deformable frame.

4. The folding roller of claim 2, wherein the deformable frame is equipped with an elastic return member.

5. The folding roller of claim 2, wherein the at least one gripping member is housed in a longitudinal housing formed in a body of the folding roller.

6. The folding roller of claim 2, wherein the at least one gripping member comprises a shaft supported in the folding roller to pivot about the pivoting axis, and wherein said at least one piezoelectric actuator is positioned at a first end of the shaft.

7. The folding roller of claim 6, wherein the piezoelectric actuator is positioned on a head of the folding roller.

8. The folding roller of claim 2, wherein the deformable frame of the piezoelectric actuator is connected to the at least one gripping member by an elastic plate.

9. The folding roller of claim 2, wherein a second piezoelectric actuator of said at least one piezoelectric actuator is associated with the at least one gripping member, and is synchronized with a first piezoelectric actuator of said at least one piezoelectric actuator.

10. The folding roller of claim 9, wherein said second piezoelectric actuator is associated with a second end of a shaft supported in the folding roller to pivot about the pivoting axis and the first piezoelectric actuator is associated with a first end of the shaft.

11. The folding roller of claim 2, wherein said at least one gripping member is at least one first gripping members and a second gripping member, with at least a respective one of said at least one piezoelectric actuator, for controlling the pivoting movement of the second gripping member.

12. The folding roller of claim 2, comprising a control unit for coordinating the at least one piezoelectric actuator with rotation movement of the folding roller.

13. The folding roller according to claim 2, wherein the deformable frame is an elastically deformable frame.

14. A folding machine comprising at least a first feed path for feeding at least a first web material toward a folding unit, and members for forming packs of folded sheets produced from the web material;

wherein the folding unit includes a first folding roller with a rotation axis;

wherein the first folding roller comprises at least one gripping member extending longitudinally along the first folding roller, and at least one piezoelectric actuator for controlling a pivoting movement of the at least one gripping member about a pivoting axis thereof parallel to the rotation axis of the first folding roller;

wherein the at least one piezoelectric actuator comprises an active piezoelectric element contained in an amplification member of deformations of the active piezoelectric element caused by a voltage applied to said active piezoelectric element; and wherein the amplification member comprises a deformable frame, which amplifies the deformations of the active piezoelectric element caused by an electrical voltage applied to said active piezoelectric element.

15. The folding machine of claim 14, wherein the folding unit comprises a second folding roller with a rotation axis;

wherein the second folding roller comprises at least one gripping member extending longitudinally along the second folding roller, and at least one piezoelectric actuator for controlling a pivoting movement of the at least one gripping member about a pivoting axis thereof parallel to the rotation axis of the second folding roller; and wherein the at least one piezoelectric actuator comprises an active piezoelectric element contained in an amplification member of deformations of the active piezoelectric element caused by a voltage applied to said active piezoelectric element.

16. The folding machine of claim 15, wherein the first folding roller and the second folding roller are arranged parallel to each other and define a folding nip.

17. The folding machine of claim 15, wherein the first folding roller and the second folding roller are configured to form a continuous stack of web material folded in a zig-zag, and wherein downstream of the first folding roller and the second folding roller there is arranged a cutting device adapted to cut the web material folded in a zig-zag into two stacks of folded sheets.

18. The folding machine of claim 14, comprising a second feed path for feeding a second web material toward the folding unit.

19. The folding machine of claim 14, further comprising, along each feed path of the web material, cutting members for cutting a respective web material into a sequence of single sheets separate from one another, the cutting members being arranged upstream of the folding roller.

20. The folding machine of claim 19, configured as an interfolding machine.

21. The folding machine of claim 14 comprising members for producing stacks of folded sheets superimposed on one another.

22. A folding machine comprising at least a first feed path for feeding at least a first web material toward a folding unit, and members for forming packs of folded sheets produced from the web material;

wherein the folding unit includes a first folding roller with a rotation axis;

wherein the first folding roller comprises at least one gripping member extending longitudinally along the first folding roller, and at least one piezoelectric actuator for controlling a pivoting movement of the at least one gripping member about a pivoting axis thereof parallel to the rotation axis of the first folding roller; and wherein the at least one piezoelectric actuator comprises an active piezoelectric element contained in an amplification member, wherein the deformations of the active piezoelectric element caused by a voltage applied to said active piezoelectric element are amplified to obtain desired displacement of the piezoelectric actuator.

* * * * *